US006491756B1

(12) United States Patent
Platsch et al.

(10) Patent No.: US 6,491,756 B1
(45) Date of Patent: Dec. 10, 2002

(54) METHOD AND DEVICE FOR SPRAYING WORKPIECES

(75) Inventors: Hans Platsch, Stuttgart (DE); Walter Klaschka, Tiefenbronn (DE); Albert Kiessling, Weil der Stadt (DE)

(73) Assignee: Klaschka GmbH & Co. (DE)

( * ) Notice: Subject to any disclaimer, the term of this patent is extended or adjusted under 35 U.S.C. 154(b) by 0 days.

(21) Appl. No.: 09/548,856

(22) Filed: Apr. 13, 2000

(30) Foreign Application Priority Data

Apr. 14, 1999 (DE) ..... 199 16 761

(51) Int. Cl.[7] ..... B05C 11/00
(52) U.S. Cl. ..... 118/666; 118/684; 118/627
(58) Field of Search ..... 118/666, 627, 118/634, 625, 684

(56) References Cited

U.S. PATENT DOCUMENTS 3,756,312 A * 9/1973 Shah et al. ..... 165/26
3,833,943 A * 9/1974 Sturtevant ..... 4/10
4,132,357 A * 1/1979 Blackinton ..... 239/11
4,170,193 A * 10/1979 Scholes et al. ..... 118/627
4,187,870 A * 2/1980 Akkerman ..... 137/102
4,247,581 A * 1/1981 Cobbs, Jr. et al. ..... 427/373
4,280,806 A * 7/1981 King ..... 431/208
4,583,582 A * 4/1986 Grossman ..... 165/32
4,702,014 A * 10/1987 Karrer ..... 34/15
5,431,315 A * 7/1995 Chun et al. ..... 222/590

FOREIGN PATENT DOCUMENTS

DE U 90 13 885 1/1991
DE A 40 13 064 10/1991
DE T 691 03 218 12/1991
DE A 42 17 527 12/1992
DE A 195 44 016 6/1997

OTHER PUBLICATIONS

*Impossible—but put into practice: 100% UV–Systems manually sprayed*, I–Lack, 12/98, pp. 694–698.

* cited by examiner

*Primary Examiner*—Richard Crispino
*Assistant Examiner*—Yewebdar T. T.
(74) *Attorney, Agent, or Firm*—Factor & Partners

(57) ABSTRACT

It is proposed in order to adjust the release quantities of spraying heads (58), by means of which lubricant is sprayed onto surface areas of metal sheets (10), to provide a temperature regulation for the lubricant and to control the lubricant release by the spraying heads (58) via the temperature adjustment. The temperature adjustment of the lubricant is effected by using a heat exchanger (16) circulating hot water.

15 Claims, 3 Drawing Sheets

METHOD AND DEVICE FOR SPRAYING WORKPIECES

Figure 1:
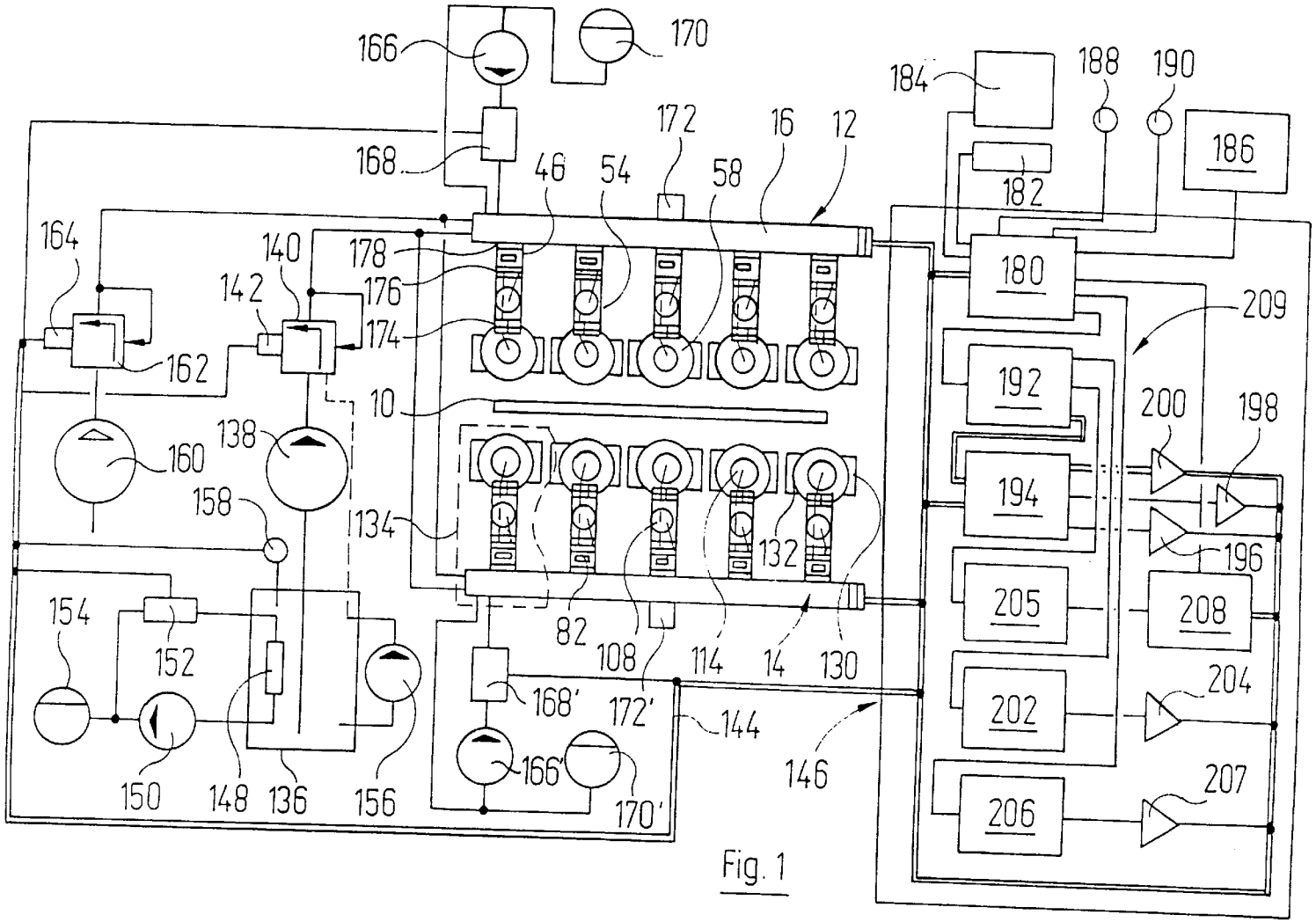

The invention relates to a method for spraying workpieces with a fluid, and, such as a lubricant, and an associated device for spraying workpieces with a fluid, such as a lubricant.

A method of this type is described in DE 195 44 016 A1.

In this specification, the adjustment of the quantity of operating fluid atomised by the spraying head is effected over a limited range by means of a motor-adjustable nozzle needle.

By way of the present invention, a method of the initially stated type is to be provided, which allows for the adjustment of the quantity per unit of time of operating fluid atomised by the spraying head over a wider range.

This object is attained according to the invention by the features disclosed in claim 1.

In a method according to the invention, use is made of the fact that the operating fluids which are usually to be applied to workpieces are viscous. In the temperature range of interest in this case (room temperature to 80° C.), the viscosity of fluids typically varies approximately proportional to the square of the ratio (in C.°) between the difference between the temperature T (° C.) in question and the melting temperature of the water Ts and room temperature Tr (° C.) and Ts, i.e. proportional to $(T-Ts)^2/(Tr-Ts)^2$. At T=80° C., the viscosity is therefore 16 times lower than at room temperature.

In practice, application quantities of approximately 0.8 to 10 $g/m^2$ are obtained.

The rate of operating fluid passing through the spraying head can also be adjusted via the pressure at which the operating fluid is supplied to the spraying head. In practice, it is possible to attain a throughput control by a factor of approximately 2 by varying the supply pressure between 5 bar and 10 bar.

If both possibilities of rate control are combined, it is possible to obtain an overall adjustment range of the throughput by a factor of approximately 25. The temperature adjustment and the pressure adjustment can be carried out with precision by using conventional control methods, so that precise application quantities can also be ensured. Now the application quantity and temperature or pressure relate to one another in detail depends upon the physical (and to some degree also the chemical) properties of the respective operating fluid and the respective spraying heads which are used. The method according to the invention is preferably used in such a manner that these dependencies are firstly determined in tests, the test results are deposited in stores and by using these stored test results the temperature and/or pressure is/are adjusted in such a manner that the desired application quantity of operating fluid is obtained.

Typical operating fluids are, more particularly, oils having various physical and chemical properties, as are used for spraying metal sheets prior to pressing or deep drawing operations.

Advantageous developments of the invention are contained in subclaims.

The development of the invention in a preferred embodiment allows for careful heating of the operating fluid by using a heating medium having a higher temperature over a large contact area. In contrast, the introduction of corresponding quantities of heat directly from an electrical heating device could result in losses in quality of the operating fluid.

One embodiment of the invention offers the advantage that a large quantity of heat can be supplied in a compact volume. The use of water as a heating fluid also offers the advantage that it is possible to fall back on the tried and tested technology of water heating devices and water heat exchangers. Furthermore, water also has relatively good thermal conductivity.

The development of the invention in one embodiment allows for a simple continuous and reproducible supply of heat to the heating fluid.

The development of the invention in another embodiment allows for a further increase in the throughput adjustment range.

By way of one embodiment of the invention, an overall fine adjustment of the application quantity is obtained, and it is also possible to ensure a short control constant as compared with a temperature adjustment alone by dividing the overall adjustment between a temperature adjustment, a pressure adjustment and a key time adjustment.

For some applications, it is advantageous if the opposing sides of a workpiece (e.g. metal sheet) can be differently sprayed with operating fluid. In this manner, it is possible to take into account that the mechanical stresses to which both surfaces are subjected during the subsequent treatment of the workpieces (e.g. deep drawing of a metal sheet), can differ. It is also possible, if desired, to spray the two sides of the workpiece with different operating fluid.

The development of the invention as claimed in claim 8 also allows for a local variation in the application quantity when spraying only a single side according to the respective anticipated requirements. Thus, for example, it is possible to coat areas of metal sheets which are to be pressed which undergoes minimal deformation in the pressing mould with a small quantity of operating fluid, whilst spraying areas which are heavily deformed in the pressing mould with a large quantity of operating fluid.

With the present invention, the temperature adjustment is effected in a connecting line leading to the spraying heads, which in practice is a ring conduit. The heating device provided to this end therefore only needs to have a smaller heating capacity than in cases where the temperature of the entire supply of operating fluid in a supply receptacle is adjusted. A further advantage of the solution according to the invention is that the temperature adjustment takes place with a smaller control constant, since the respective volumes which need to be adjusted to the desired temperature are small as compared with the content of a supply receptacle.

The development of the invention in one embodiment is again advantageous with a view towards careful heating of the operating fluid.

In one embodiment of the device, a circulated heating medium is used, in which only the arising heat losses are compensated. This is advantageous with a view towards low energy consumption and with a view towards corrosion protection of the primary circuit of the heat exchanger.

The developments of the invention in certain embodiments are advantageous with a view towards a rapid and precise adjustment of the temperature conditions in the primary circuit and in the secondary circuit of the heat exchanger. Thus, in cases where a temperature increase is desired, it is possible to firstly supply considerably more heat to the primary circuit than is required during stationary operation. As a result of the constant monitoring of the temperatures, overshooting is prevented as well as an excessively slow approach of the temperature to the stationary end value.

The development of the invention in certain embodiments ensure monitoring of the fluid flows in the primary and secondary circuits of the heat exchanger. From the output signal of the flow meter or flow sensor, it is also easily possible to determine if a circulating pump fails or if other disturbances occur during the conveyance of the fluids.

In certain embodiments, a heat exchanger can be manufactured in a very simple manner from finished components which only need to be brought into contact with one another with sufficiently large surface areas.

In one embodiment, the duct of the heat exchanger conveying the operating fluid can simultaneously undertake a supportive function for the spraying heads as well as a distributive function for the latter.

In another embodiment, the entire heat exchanger can be manufactured very simply and economically as an integrally formed part.

The development of the invention in another embodiment is advantageous with a view towards a constant temperature adjustment in the longitudinal direction of the heat exchanger.

The development of the invention in another embodiment is advantageous with a view towards uniform heating of the operating fluid from both sides.

In the device in one embodiment, compressed air, which a spray head possibly required for atomisation or for shaping the generated mist, is heated to the temperature of the operating fluid before it is supplied to the spraying heads.

In this respect, the development of the invention in one such embodiment is again advantageous with a view towards a simple realisation both of the first heat exchanger and of the second heat exchanger by a single extruded multi-chamber profile.

The development of the invention in another embodiment allows for a simple, clear fitting, which is also expedient for maintenance, of the spraying heads to a duct conveying the operating fluid.

In another embodiment, it is possible in a simple manner to maintain the spraying heads per se at the same temperature as the supplied operating fluid.

In this respect, the development of the invention in one such embodiments is advantageous with a view towards a uniform temperature adjustment in the spraying head.

In one embodiment of the device, the compressed air supply of the spraying head is also effected via the adapter element supporting said spraying head. No separate compressed air lines are therefore required. The spraying head can be dismantled and fitted in a particularly simple manner.

In one embodiment of the device, the compressed air control associated with a spraying head is spatially combined in a simple manner with the adapter element, which is in turn advantageous for reasons relating to assembly and facility of inspection.

The development of the invention according to one embodiment means that it is possible to carry out a final fine adjustment of the temperature of the fluid which is to be atomised by the spraying head directly at the spraying head. In this manner, it is possible to account for locally varying ambient temperatures in the case of long spraying head strips. Thus, for example, the spraying heads lying in the centre of a spraying head strip follow the temperature of the adjacent spraying heads, so that their thermal losses are less than those of the peripheral spraying heads. The different spraying heads of a spraying head strip can also lie in different flows of the surrounding atmosphere, partially as a result of the design of a protective housing enclosing the spraying heads or the spraying head strips, partially as a result of the air flows at the installation site (factory hall).

In this respect, the development of the invention in one such embodiment is advantageous with a view towards a simple automatic temperature adjustment at the spraying heads.

According to another embodiment of the invention, the electrical cabling of a spraying head strip can also be fitted in a compact manner allowing for ease of inspection.

The developments of the invention in one preferred embodiment are advantageous with a view towards simple replaceability of the individual spraying heads and the adapter element associated therewith, without major intervention into the overall installation.

Figure 2:
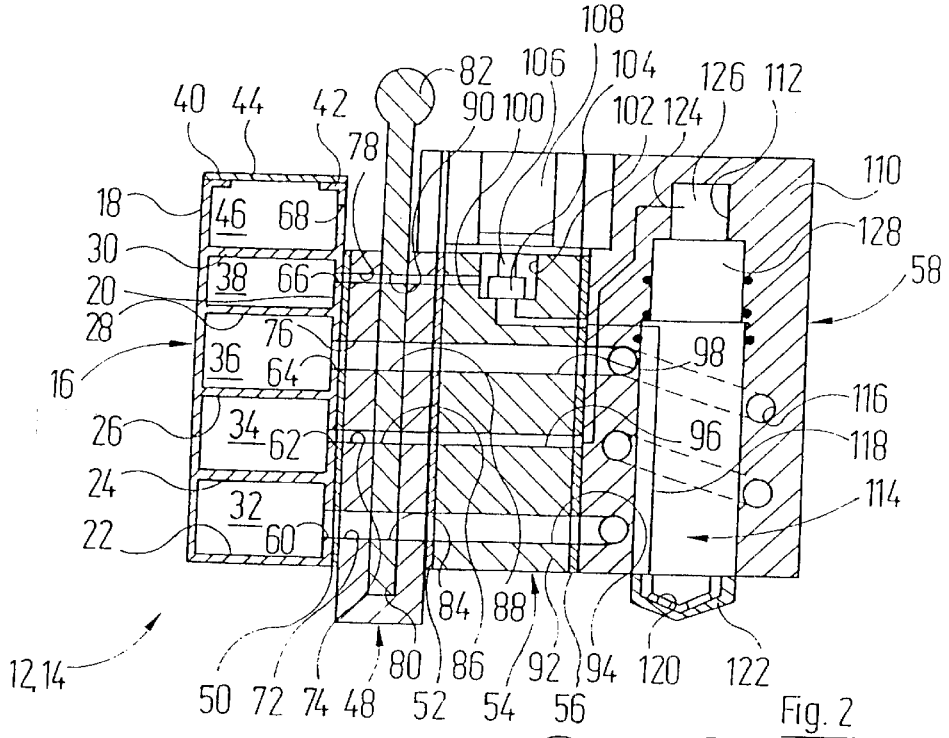
Figure 3:
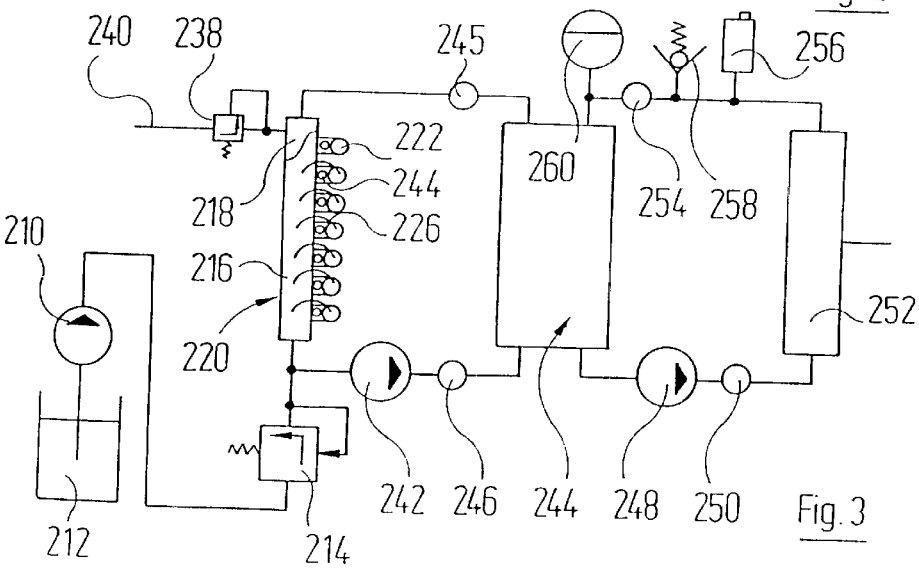
Figure 4:
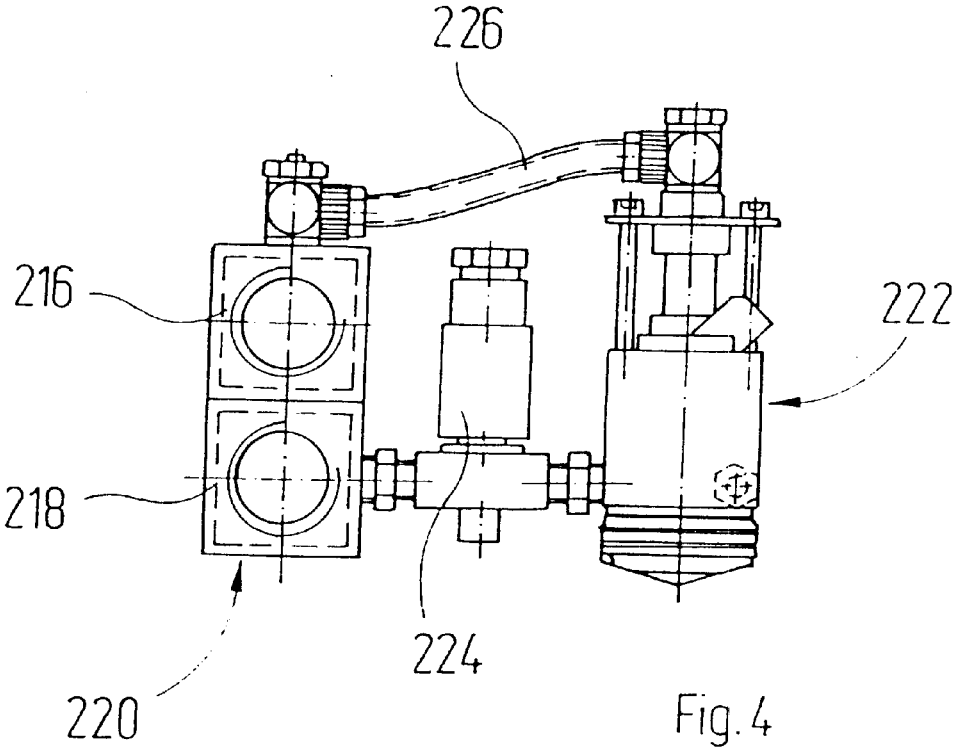
Figure 5:
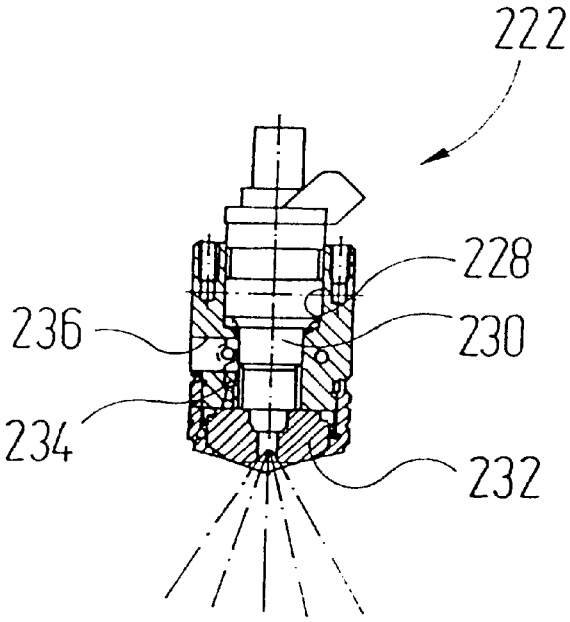

The invention will be described in further detail in the following with the aid of embodiments with reference to the drawings, in which:

FIG. 1: is a circuit diagram of a device for double-sided spraying of metal sheets with a fluid lubricant;

FIG. 2: is a central section through a spraying head, an adapter element supporting said spraying head, a valve block and a supply profile of the device according to FIG. 1;

FIG. 3: is a circuit diagram of a simplified device for spraying metal sheets with a fluid lubricant from one side only;

FIG. 4: is a side view of a spraying head strip of the device according to FIG. 3; and FIG. 5: is an axial section through a spraying head of the spraying head strip according to FIG. 4.

In FIG. 1, the reference 10 designates a rectangular metal sheet viewed from above, which is to be sprayed with operating fluid on its upper side and underside. To this end, an upper spraying head strip 12 and a lower spraying head strip 14 are provided.

In FIG. 1, the latter are pivoted by +70° and −70° respectively from their actual position in which they form an angle with their spraying axes of approximately 70° to the conveying direction of the metal sheet 10, in such a manner that the horizontal components of the released atomised flows oppose the conveying direction. As a result, of this rotated illustration of the spraying head strips 12 and 14, details of these strips can be shown more clearly.

The spraying head strips 12 and 14 have a symmetrical construction relative to the conveying plane of the metal sheet 10, so that it is sufficient to describe one of the spraying head strips in further detail in the following. Insofar as a distinction is necessary, the components of the spraying head strip 14 are characterised by an apostrophe.

The spraying head strips 12, 14 each comprise a base section 16, which is an extruded multi-chamber profile, details of which are visible in FIG. 2, and, which also serves as a heat exchanger.

Two side walls 18, 20 are connected to one another by transverse walls 22, 24, 26, 28, 30. In this manner, a lowermost return duct 32, an overlying lubricant duct 34, a further overlying lead duct 36 and a further overlying compressed air duct 38 are obtained. Radially inwardly projecting assembly flanges 40, 42 are moulded onto the upper end sections of the side walls 18, 20 extending beyond the transverse wall 30. Fitted onto said assembly flanges 40, 42 is a cover element 44, which can also be manufactured by cutting an extruded continuous material to length. In this manner, the cover element 44 together with the transverse wall 30 defines a cable duct 46.

Fitted onto the side wall 18, e.g. by screwing, is a valve block, designated in its entirety by 48, with the interposition of a flat gasket 50 comprising matching through apertures for the various ducts. The side of the valve block 48 remote from the base section 16 releasably (e.g. by means of a rapid lock) supports an adapter element 54 via a further flat gasket 52 comprising duct apertures. The right-hand end face of the adapter element 54 supports a spraying head designated in its entirety by 58 with the interposition of a flat gasket 56 comprising duct apertures.

The side wall 20 is provided in the regions associated with a spraying head with a return opening 60 communicating with the return duct 32, a lubricant opening 62 communicating with the lubricant duct 34, a lead opening 64 communicating with the lead duct 36, a compressed air opening 66 communicating with the compressed air duct 38 and a cable opening 68 communicating with the cable duct 46.

The valve block 48 comprises a housing 70, which comprises a return duct 72 aligned with the return opening 60, a lubricant duct 74 aligned with the lubricant opening 62, a lead duct 76 aligned with the lead opening 74 and a compressed air duct 78 communicating with the compressed air opening 66.

The various ducts 72 to 78 are interrupted by a common valve chamber 80, in which a plate-shaped valve slide 82 is arranged in a flow medium-tight manner. The latter has control apertures 84, 86, 88, 90, which are arranged in a pattern corresponding to the arrangement of the ducts 72 to 78. The valve slide 82 is displaceable between an open position reproduced in the drawing, in which the control apertures 84 to 90 are aligned with the associated ducts 72 to 78, and a closed position shown in continuous lines, in which continuous sections of the valve slide 82 interrupt the ducts 72 to 78.

The adapter element 54 has a housing 92, in which a return duct 94, a lubricant duct 96, a lead duct 98 and a compressed air duct 100 are constructed in alignment with the ducts 72 to 78.

The compressed air duct 100 has two vertically spaced apart duct sections, which open out onto the circumferential wall or the base wall of a valve chamber 102. Provided in the latter is a valve disk 104, which is supported by a push rod 106, which is in turn displaced by an electromagnet 108.

The spraying head 58 has a housing 110, in which a stepped receiving bore 112 for an electromagnetic injection nozzle 114 is provided. The injection nozzle 114 has the same construction as a plastics material injection nozzle for Otto engines.

Constructed in the housing 110 is a helical heating duct 116, which encloses the receiving bore 112 with a slight clearance and whose ends communicate with the lead duct 98 and the return duct 94 respectively of the adapter element 94 via corresponding apertures in the flat gasket 56.

Also provided in the housing 110 is an angled compressed air duct 118, which leads to shaped air nozzle ducts 120, which are constructed in a screw cap 122, which is screwed onto the lower end of the injection nozzle 114. The air jets emitted by the shaped air nozzle ducts 120 are used for deforming the atomised fluid released by the injection nozzle 114, e.g. by flattening said atomised fluid into an elliptical cross sectional shape.

The supply of lubricant to the injection nozzle 114 is effected via an angled lubricant duct 124, which leads from the lubricant duct 96 of the adapted element 44 to an inlet section 126 of the injection nozzle 114. Disposed beneath the inlet section 126 is a valve section 128 of the injection nozzle 114, which comprises an electrical switching valve, by means of which the lubricant flow to the injection nozzle can be pulsed at high frequency (typically approximately 3,000 valve cycles/minute, maximum 30,000/minute.

As can be seen again from FIG. 1, a heating unit 130 and a temperature sensor 132 are screwed onto the housing 110 of each spraying head 58. For the sake of clarity in the drawing, these are shown as localised components, but in practice can be an electrical resistance heating strip and a temperature sensor wire, which are wound onto the housing 110, in order to supply the heat in a distributed manner and to measure the temperature in integrated fashion over the housing.

The units, formed in each case by a valve block 48, an adapter element 54 and a spraying head 58, and the base section 16 per se can be arranged in each case in a thermally insulating casing 134, only part of which is shown in FIG. 1. This can be a foam element provided with a surface skin.

The lubricant supply to the spraying head strips 12 and 14 is effected starting from a supply receptacle 136, from which a lubricant pump 138 draws. The pressure of the supplied lubricant is adjusted by a controllable pressure control valve 140. This can comprise, for example, a magnet 142 acting in the direction of closure, so that the control pressure can be electrically adjusted. The supply current for the electromagnet 142 is provided via a cable 144 by a control unit designated in its entirety by the reference 146.

In the drawings, cables are indicated throughout by double lines. It is understood that the cables 144 are not comparable with data buses, but rather contain a separate conductor for each signal which is to be transmitted. At the corresponding nodes in the cables further cables comprising a plurality of conductors, or a single conductor is/are drawn out or added.

Arranged in the interior of the supply receptacle 136 is a heat exchanger 148. By means of the latter, a flow of water is constantly circulated by means of a circulating pump 150 and is heated by a continuous flow heater 152. The latter is again supplied with current by the control unit 146 via the cable 144. In order to compensate temperature related volume changes in the hot water, a compensating receptacle 154 is connected to the water circuit. A lubricant circulating pump 156 is provided for circulating the lubricant in the supply receptacle 136.

The temperature in the interior of the supply receptacle 136 is detected by a temperature sensor 158, whose output signal is transmitted via the cable 144 to the control unit 146.

The compressed air supply of the compressed air duct 38 is effected by a compressor 160 and a controllable pressure control valve 162, whose pressure adjusting magnet 164 is again connected via the cable 144 to the control unit 146.

A hot water flow is circulated through the lead duct 36 and the return duct 32 of the base section 16. To this end, a circulating pump 166 is provided as well as a continuous flow heater 168 connected in series with the circulating pump 166. A compensating receptacle 170 is again used for receiving temperature related variations in the overall volume of water.

Hot water released by the continuous flow heater 168 is therefore conveyed in the lead duct 36 of the base section 16 and flows via the valve blocks 48 and the adapter elements 54 into the various spraying heads 58, and then, via the adapter elements 54 and the valve blocks 48, reaches the return duct 32 where it is drawn by the circulating pump 166.

The flow cross sections of the lead duct 36 and the return duct 32 are large as compared with the flow cross sections of the ducts constructed in the valve blocks 48 and the adapter elements 54, so that the different spraying heads are all uniformly supplied with hot water.

In order to dispense with a temperature gradient occurring, for instance, in the longitudinal direction of the base section 16, it is possible to provide a connection between the lead duct 36 and the return duct 32 at the end of the base section 16 remote from the connection side of the base section (on the right in the drawing), in order to increase the overall quantity of circulated hot water and therefore to increase the quantity of heat which can be released by said water. The fact that the lead duct 36 and the return duct 32 are circulated in opposite directions also contributes towards a uniform temperature adjustment in the base section 16 which is made of material having good thermal conductivity.

As a result of the fact that the lubricant duct 34 is arranged in the base section 16 between the lead duct 36 and the return duct 32, the lubricant is effectively heated in the base section from both sides to the temperature of the hot water. In order to monitor the average temperature, the base section 16 is provided in its centre with a temperature sensor 172, whose output signal is transmitted via a cable running in the cable duct 46 to the control unit 146.

As shown schematically in FIGS. 1 and 2, electrical plug connections 174 are provided between the spraying heads 58 and the adapter elements 54, electrical plug connections 176 are provided between the adapter elements 54 and the valve blocks 48, and electrical plug connections 178 are provided between the valve blocks 48 and the base section 16. In this manner, the various units supported by the base section can be easily removed as a whole or in sections.

Belonging to the electrical control unit 146 is a processor 180, which cooperates via an intersection card, not shown in further detail, with a keyboard 182, a monitor 184 and a mass store 186 (e.g. fixed plate).

Via corresponding intersections, the processor 180 also cooperates with the temperature sensors 132, the temperature sensor 158, the temperature sensors 172 and 172', an advance sensor 188 cooperating with the metal sheet and only schematically indicated, and various positions sensors cooperating with the metal sheet, of which only one is schematically illustrated at 190.

At its output side, the processor 180 is connected via suitable intersections and optionally power stages with the pressure adjusting magnets 142 and 164, the continuous flow heaters 152, 168, 168', the heating units 130 and the various pumps of the device, the connections to the various pumpd and to the fan generating the compressed air not being shown in detail.

All data required for spraying lubricant for different workpieces is stored in the mass store 186. More particularly, this data relates to those regions of the workpiece surface which are to be sprayed at all, the nature of the lubricant used and the lubricant quantities required in the different regions of the workpiece surface.

As a result of the above-described precise adjustment of the temperature of the lubricant supplied to the injection nozzle 114, it is possible to carry out a control of the lubricant quantity released by the injection nozzle 114 by way of a temperature adjustment. Since the viscosity of lubricants, roughly speaking, varies proportional to the square of the temperature (° C.), it is possible within a usable temperature range lying between room temperature or elevated room temperature (approximately 35° C.) and approximately 80°, to ensure a variation in the lubricant throughput in a simple manner by a corresponding variation in the lubricant temperature. In this manner, a rough presetting of the lubricant throughput is obtained within a wide adjustment range of the lubricant quantity between approximately 1 and a maximum of 16.

An additional and finer adjustment of the lubricant quantity in a range from 1 to 2 can be effected by adjusting the pressure of the supplied lubricant. This can be effected by the electrical signal superimposed on the electromagnet 142.

Finally, a further fine adjustment of the lubricant quantity released by the injection nozzle 114 can be effected by adjusting the ratio between open time and closed time of the injection nozzle 114, i.e. the keying ratio of the excitation signal for the electromagnet of the valve section 128.

Which proportions of the lubricant metering are allocated to which of these three adjustment possibilities is determined by an organisational computing circuit 192 as a function of the desired overall lubricant quantity, which has been called up by the processor 180 from the mass store 186 or is supplied ad hoc to the processor by input at the keyboard 182.

The organisational computing circuit 192 can effect the distribution to the three different adjustment possibilities either as a function of a predetermined algorithm or as a function of tables which are stored in the mass store 186.

In addition, the organisational computing circuit 192 can take into account that different lubricant release quantities may be desired in the longitudinal direction of the spraying head strip 12, i.e. in the direction perpendicular to the conveying direction of the metal sheets.

The organisation calculating circuit 192 therefore transmits to a temperature control circuit 194 a plurality of temperature signals, which are associated in each case with one of the spray heads 58. From these signals, the temperature control circuit 194 calculates a basic temperature control signal, which via a power stage 196 is used to control the continuous flow heater 168. In corresponding fashion, the continuous flow heater 152 is supplied with current via a second power stage 198. This is effected in such a manner that the temperature in the supply receptacle 136 lies below the minimum lubricant temperature anticipated in the control range.

Finally, the temperature control circuit 194 generates a plurality of temperature control signals for the individual spraying heads 58, which are transmitted via power stages 200 to the heating units 130.

In this manner, it is ensured that the temperature of the lubricant is adjusted as it approaches a respective spraying head 58 within ever decreasing control ranges, so that only small time constants are available for the fine adjustment of the lubricant release quantity, since the respective lubricant quantity becomes increasingly smaller.

Alternatively, the organisational computing circuit 192 can generate a temperature nominal value signal which corresponds to the maximum spraying oil quantity required in the next cycle. The reduction of this quantity to the quantity required in the moment is then effected via the pulse width modulation of the actuating signals for the electromagnets 108.

In addition, the organisational computing circuit 192 generates a pressure nominal value signal, which is transmitted to an input of a control circuit 202. The latter transmits a feed signal via a power stage 204 to the electromagnet 142.

Finally, the organisational computing circuit 192 transmits a keying ratio nominal value signal to an injection pulse generator 205, which converts this signal into cyclical control pulses for the electromagnets of the valve sections 128.

A control signal 206 is provided, which is used by the processor 180 [to generate] a compressed air nominal value signal determining the spraying jet geometry for producing a control signal for the electromagnet 164, again with the interposition of a power stage 207.

The compressed air nominal value signal can be predetermined by the processor 180 as a function of distance, i.e. based on the output signal of the advance sensor 188, so that the spraying pattern can be varied as a function of distance.

The output signal of the injection pulse generator 205, which determines the opening and closing times of the injection nozzles 114, is transmitted to an overlay circuit 208, which in AND fashion links the keying ratio with the spraying pattern which is to be produced on the workpiece, which is called up by the processor 180 from the mass store 186 and is reproduced line by line in the overlay circuit 204 according to the advance of the metal sheet 10. The overlay circuit 208 therefore transmits control signals to the different injection nozzles 114, by means of which control signals the injection nozzles 114 are opened and closed at predetermined moment in time.

The components 192 to 204 together form a control duct designated by the reference 209. A corresponding control duct for the spraying head strip 14 has the same construction and is not shown in FIG. 1.

It can be seen that by using the device described above with the aid of FIGS. 1 and 2, it is possible to spray a metal sheet in a variable and precise manner with lubricant, the lubricant quantity being adjustable within a wide range of approximately 1 to 8, an adjustment factor of 6 being effected via the temperature adjustment, an adjustment factor of 2 via the adjustment of the pressure of the supplied lubricant. A further adjustment possibility lies in the keying ratio between open and closed times of the injection nozzles 114. In total, an adjusting range of approximately 1 to 10 can therefore be obtained or 1 to 100 depending of the interval duration of the spraying head control signals (at longer intervals, the keying ratio can be varied within a wider range than during shorter intervals).

Final fine adjustments of the released lubricant quantities can be effected via a temperature fine adjustment at the individual spraying heads 58 by means of the heating units 130.

FIGS. 3 to 5 show a second embodiment, in which a simply constructed device for spraying a metal sheet from one side only is shown.

A lubricant pump 210 draws from a supply receptacle 212. Its conveying side is connected via a pressure control valve 214 to an extruded oil duct element 216 (cf. also FIG. 4), which is connected in a thermally conductive manner to a compressed air duct element 218 manufactured from the same profile material. The duct elements 216 and 218 together form a heat exchanger 220, which simultaneously acts as a support element for spraying heads 222. The latter are connected via a magnetic valve 224 to the compressed air duct element 218 and via hose connections 226 to the oil duct element 216.

As can be seen from FIG. 5, the spraying heads 222 each have a housing 228, which is constructed with a stepped bore and in which an injection nozzle 230 sits. On its outlet side, the injection nozzle 230 is enclosed by a nozzle cap 232, which communicates via a compressed air duct 234 with a compressed air connection aperture 236.

The interior of the compressed air duct element 218 is connected via a pressure control valve 238 to a compressed air line 240.

The oil duct element 216 is connected at one end of the outlet of the pressure control valve 214. The outlet of the pressure control valve 214 is also connected to the inlet of a circulating pump 242, which is connected to the inlet of the secondary circuit of a heat exchanger 244. The outlet of the secondary circuit of the heat exchanger 244 is connected via a temperature measuring element 245 to the second terminal of the oil duct element 216. A flow meter 246 monitors the lubricant flow through the heat exchanger 244.

The primary circuit of the heat exchanger 244, which is constructed as a plate heat exchanger, is connected to a hot water circuit.

The hot water outlet of the heat exchanger 244 is connected to the inlet of a circulating pump 248, which is connected via a flow meter 250 to the inlet of a continuous flow heater 252.

Fitted into the connected line between the outlet of the continuous flow heater 252 and the hot water inlet of the heat exchanger 244 is a temperature sensor 254. Also connected to this connecting line is a ventilator 256, an excess pressure valve 258 and an expansion tank 260.

The device explained with reference to FIGS. 3 to 5 can be controlled in a similar manner as described above for the device according to FIGS. 1 and 2.

The temperature of the lubricant supplied to the oil duct element 216 can be predetermined by a corresponding electrical control of the continuous flow heater 252, in order to control a rough adjustment of the lubricant release through the different injection nozzles 230.

A further possibility of determining the released lubricant quantity is the control pressure of the pressure control valve 214. It is possible to make use of this possibility in the considered embodiment by a manual adjustment of the pressure of the pressure control valve 214, although the control pressure can again be electrically adjusted, as described above. Finally, the released lubricant quantity can again be determined via the ratio between open time and closed time of the injection nozzles 230. The shape of the atomised flows released by the spraying heads 222 can be determined via the pressure control valve 238.

More precisely, a control unit, not shown in the drawings, for the spraying device illustrated in FIGS. 3 to 5 can operate in a similar manner to the control described above with reference to FIG. 1.

What is claimed is:

1. A device for spraying work pieces with an operating fluid, comprising:

a) at least one spraying head (58; 222), b) a supplier receptacle (136; 212) for an operating fluid which is to be applied by spraying, c) a feed pump (138; 210) for conveying the operating fluid from the supplier receptacle (136; 212) to the spraying heads (58; 222);

d) a device for adjusting the flow of the operating fluid supplied to the spraying heads (58; 222) including (i) a heating device (130; 168; 244 to 260) comprising a heat exchanger (16; 244) fitted into a connecting line which extends between the outlet of the feed pump (138; 210) and the spraying heads (58; 222), wherein the heat exchanger (16) comprises at least two ducts (32, 34, 36) coupled to each other, to, in turn, facilitate thermal conduction between the at least two ducts; and (ii) flow control means selected from the group consisting of an electrical switching valve (128) controlling the open time and closed time of the spraying heads and a pressure control valve (140).

2. A device as claimed in claim 1, wherein the duct (34) of the heat exchanger (16) conveying the operating fluid simultaneously acts as a distribution pipe for a plurality of spraying heads (58) connected to said duct.

3. A device as claimed in claim 1, wherein the ducts (32, 34, 36) are formed by an extruded multi-chamber profile, which is made of a material having good thermal conductivity.

4. A device as claimed in claim 3, wherein the heat exchanger (16) comprises a lead chamber (36) and a return chamber (32) for heating medium.

5. A device as claimed in claim 4, wherein heating medium flows through the lead chamber (36) and the return chamber (32) in opposite directions.

6. A device as claimed in claim 4, wherein a chamber (34) conveying the operating fluid is positioned between the lead chamber (36) and the return chamber (32).

7. A device for spraying work pieces with an operating fluid, comprising:

a) at least one spraying head (58; 222), b) a supplier receptacle (136; 212) for an operating fluid which is to be applied by spraying, c) a feed pump (138; 210) for conveying the operating fluid from the supplier receptacle (136; 212) to the spraying heads (58; 222);

d) a device for adjusting the flow of the operating fluid supplied to the spraying heads (58; 222) including (i) a heating device (130; 168; 244 to 260) comprising a heat exchanger (16; 244) fitted into a connecting line which extends between the outlet of the feed pump (138; 210) and the spraying heads (58; 222) and a second heat exchanger (36, 38; 220), through which the operating fluid and/or a heating medium and additionally compressed air flows; and (ii) flow control means selected from the group consisting of an electrical switching valve (128) controlling the open time and closed time of the spraying heads and a pressure control valve (140).

8. A device as claimed in claim 7, wherein the second heat exchanger comprises a further chamber (38) of the extruded multi-chamber profile, which simultaneously forms a compressed air distribution line, to which compressed air inlets of the spraying heads (58) are connected.

9. A device as claimed in claim 1, wherein the spraying heads (58) are releasably connected to the duct section (34) conveying the operating fluid via adapter elements (54), which each comprises a supply duct (96) for the operating fluid.

10. A device as claimed in claim 9, wherein the adapter elements (54) additionally comprise a lead duct (98) and a return duct (94) for heating medium and the housings 110) of the spraying heads (58) comprise a heating duct (116), whose ends are connected to the lead duct (98) and the return duct (94) respectively of the associated adapter element (54).

11. A device as claimed in claim 10, wherein the heating duct (116) encloses a nozzle receiving bore (112) of the housing (110) of a spraying head (58), preferably in a helical manner.

12. A device as claimed in claim 9, wherein the adapter elements (54) each comprise a compressed air supply duct (100), which leads to a compressed air connection aperture of the associated spraying head (58).

13. A device as claimed in claim 12, wherein the adapter elements (54) each comprises a compressed air control valve (102 to 108) fitted into the compressed air supply duct (100).

14. A device as claimed in claim 9, wherein the adapter elements (54) are each preferably detachably supported by a valve block (48), which comprises a duct arrangement (72 to 78) which corresponds to the duct arrangement of the adapter elements (54) and is closable by a valve arrangement (80, 82).

15. A device as claimed in claim 14, wherein the valve arrangement comprises a single, preferably plate-shaped control element (82).

* * * * *